US008863628B2

(12) United States Patent
Perini

(10) Patent No.: US 8,863,628 B2
(45) Date of Patent: Oct. 21, 2014

(54) APPARATUS FOR TRIMMING PAPER ROLLS OR LOGS AND AN OPERATING METHOD FOR TREATING THE LOGS

(76) Inventor: Fabio Perini, Viareggio (IT)

( * ) Notice: Subject to any disclaimer, the term of this patent is extended or adjusted under 35 U.S.C. 154(b) by 1201 days.

(21) Appl. No.: 12/145,693

(22) Filed: Jun. 25, 2008

(65) Prior Publication Data

US 2009/0000447 A1 Jan. 1, 2009

Related U.S. Application Data

(62) Division of application No. 10/524,001, filed as application No. PCT/IT03/00458 on Jul. 25, 2003, now Pat. No. 7,827,892.

(30) Foreign Application Priority Data

Aug. 9, 2002 (IT) ..... FI02A0155

(51) Int. Cl.

| | |
|---|---|
| ***B26D 1/00*** | (2006.01) |
| ***B26D 7/06*** | (2006.01) |
| ***B26D 7/02*** | (2006.01) |
| ***B26D 3/16*** | (2006.01) |
| *B26D 7/01* | (2006.01) |

(52) U.S. Cl.

CPC .. *B26D 3/16* (2013.01); *B26D 7/02* (2013.01); *B26D 3/166* (2013.01); *B26D 7/06* (2013.01); *B26D 2007/013* (2013.01); *B26D 3/161* (2013.01); *B26D 7/0683* (2013.01)

USPC ..... 83/407; 83/409

(58) Field of Classification Search

CPC ..... B26D 3/161; B26D 7/02; B26D 7/0683; B26D 2007/013; B26D 3/166; B26D 3/16; B26D 7/06; B26D 7/22; B26D 7/12; B26D 7/08; B26D 7/00; B26D 1/01; B26D 7/32; B26D 1/10; B26D 2210/11

USPC ..... 83/407, 409, 13, 155, 483, 277, 272, 83/255, 174, 155.1, 401, 676, 411.6, 168, 83/411.5, 411.3, 23, 112, 38, 37, 329; 242/532.3, 533.1

See application file for complete search history.

(56) References Cited

U.S. PATENT DOCUMENTS

| | | | | |
|---|---|---|---|---|
| 2,047,021 | A * | 7/1936 | Friden | 83/411.6 |
| 3,282,444 | A * | 11/1966 | McConnell | 414/745.9 |
| 3,905,260 | A * | 9/1975 | Nystrand | 83/155 |
| 4,558,617 | A * | 12/1985 | Boelen | 83/425.1 |
| 5,142,955 | A * | 9/1992 | Hale | 83/75.5 |
| 2002/0007710 | A1 * | 1/2002 | Newnes | 83/75.5 |
| 2002/0038588 | A1 * | 4/2002 | Newnes et al. | 83/75.5 |

* cited by examiner

*Primary Examiner* — Ghassem Alie
(74) *Attorney, Agent, or Firm* — McGlew and Tuttle, P.C.

(57) ABSTRACT

Apparatus for trimming paper rolls or logs (2) characterized in that it comprises: a section for the entry of the logs (2) to be trimmed; a section for the exit of the trimmed logs (2'); a station with cutting means (6) for trimming the logs (2); means (3) for moving the logs (2, 2') between the entry section, the cutting station and the exit section; means (4), associated with the log-moving means (3), for retaining the logs when subjected to movement.

17 Claims, 11 Drawing Sheets

APPARATUS FOR TRIMMING PAPER ROLLS OR LOGS AND AN OPERATING METHOD FOR TREATING THE LOGS

CROSS REFERENCE TO RELATED APPLICATIONS

This application is a divisional application under 37 CFR 1.53(b) of pending prior application Ser. No. 10/524,001 filed Feb. 8, 2005 and claims the benefit (35 U.S.C. §120 and 365©) of International Application PCT/IT2003/000458 of Jul. 25, 2003, which designated inter alia the United States and which claims the priority of Italian Application FI2002A000155 of Aug. 9, 2002. The entire contents of each application is hereby incorporated by reference in its entirety.

FIELD OF THE INVENTION

The present invention refers to an apparatus for trimming paper rolls or logs and to an operating method for treating the logs.

BACKGROUND OF THE INVENTION

In the description that follows, the term paper rolls and, its equivalent term "logs" refer to rolls of web material (such as paper) wound up around a support core (e.g. a cardboard tubular core) to be cut in order to form rolls of smaller dimensions, that is, of commercial size.

The current production of small rolls of paper is known to include cutting transversely the logs produced by a rewinding machine and with the use of one or more cutting-off machines.

A cutting-off machine for logs is described in details in the document IT 1247330.

In practice, a cutting-off machine of this type includes:

- a plurality of channels or guides into which the logs are unloaded, and in correspondence of which movable devices, so-called "porters", are mounted and operated for moving longitudinally the logs by pushing them from the back;
- a cutting station, comprising one or more circular blades rotating about axes parallel to those of the logs and fixed onto a corresponding movable support; and
- means for discarding the waste, that is, the end trims produced in the cutting station.

During the normal operation, a log to be cut is disposed by a relevant porter unit in a preset position onto the respective guide, the same log is retained in such position, and one of the blades is operated, that is, is driven in a plane orthogonal to the log's axis, so as to form a shorter roll of preset size. The length of the small roll depends actually on the advancement of the porter unit during the time elapsing between two consecutive actuations of the blades.

The current production processes imply some degree of inaccuracy in the formation of the logs. In fact, the cores are likely either to project from the ends of the wound-up material or to result thereinside. Moreover, the end bases of the logs may result oblique with respect to the longitudinal axes thereof and their consistence may lack in uniformity.

In conclusion, the length of the logs is never the same, both owing to the process irregularities and to the deformations induced by the pressure exerted by the porter units onto poor-consistence bases of the logs, which deformations bring about errors in the advancement of the porter units and are thus the cause of inaccuracy on the lengths of the small rolls formed from the logs. Such inaccuracies result crucial when the cuts must be made at preset distances from printed pictures or other imprint figures formed on the paper of the logs.

Besides, the first and the last cuts, required for trimming the logs in correspondence of their two ends, generate waste or trims which must be detached from the small rolls before putting the latter on the market. Provision is made therefore for using means intended to separate the trims, which means are never totally efficient and their intervention is likely to prejudice the quality of the small rolls.

A further drawback related to this log-trimming technique lies in the poor quality of the trimming cuts: in order to keep the production waste at a minimum, the length of the trims is minimal but, owing to the lack of homogeneity of the material close to the end bases, the corresponding cuts are hardly ever orthogonal to the axis of the logs, so that, most of the times, for each log there are produced two imperfect small rolls (one for each end of the log), also due to the high cutting speed and to the shape of the chamfer of the blades. The result is that, generally, the adopted solution is a trade-off which fulfills only in part the requirements for the trimming and cutting-off of the logs.

SUMMARY OF THE INVENTION

The main object of the present invention is to overcome the above mentioned drawbacks.

This result has been achieved, according to the invention, by adopting the principles set forth in the independent claims.

Further characteristics being disclosed in the dependent claims.

The present invention makes it possible to simplify and improve the log-cutting process. Moreover, it allows to simplify the structure and operation of the cutting-off machines, as the section for the removal of the trims from the logs is unnecessary and, accordingly, it can be suppressed. In addition to this, the apparatus according to the invention is easy to make, cost-effective and reliable even after a prolonged service life.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
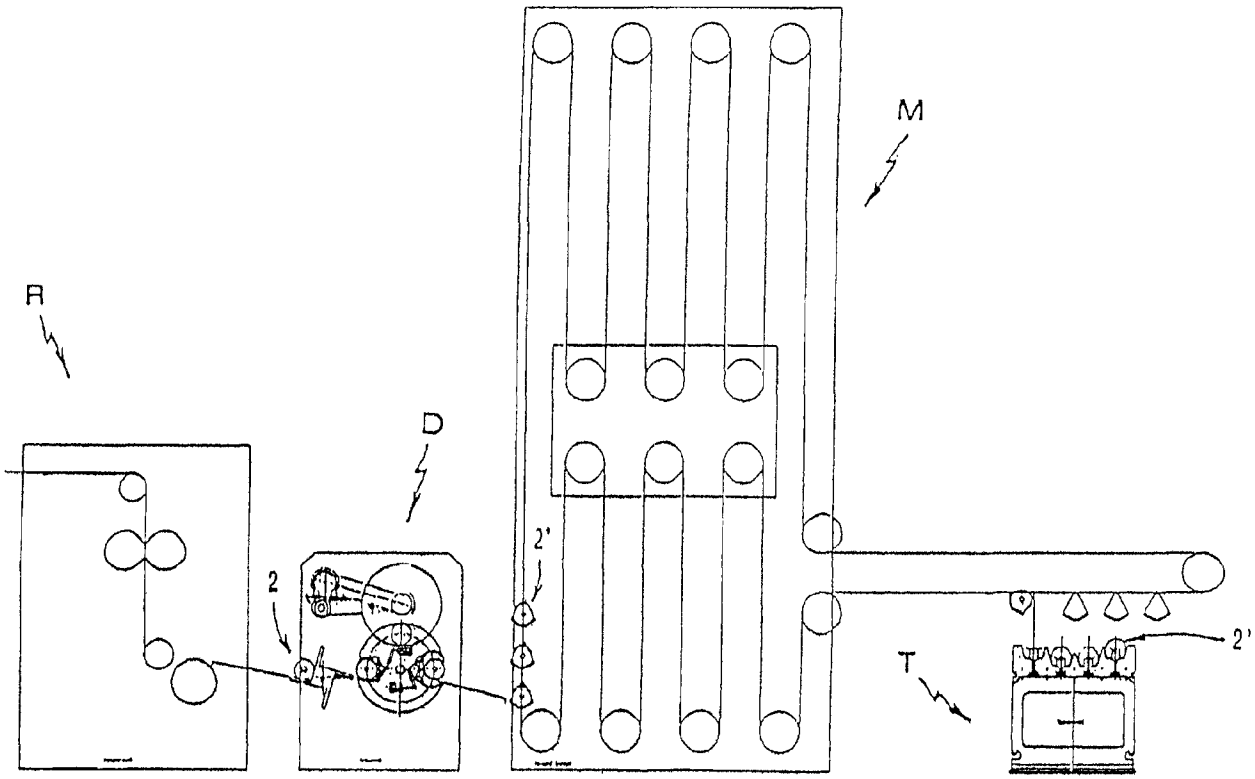
FIGS. 1-4 are schematic views showing different positions of an apparatus according to the invention within a plant for the production of paper rolls of commercial size.

Reduced to its basic structure, and reference being made to the FIGS. 5A-5F of the attached drawings, an apparatus (D) according to the invention comprises:

A plane (1) for the entry of logs (2) produced upstream of a rewinder (R);

a revolving unit (3) comprising a plurality of housings (30) for the logs (2) which come one at a time from the entry plane (I), and provided with means (4) for holding each log (2) in a corresponding housing (30) and respectively releasing it;

means (5), disposed and acting between the entry plane (1) and the revolving unit (3), in order to transfer the logs (2) from the plane (1) to the revolving unit (3);

cutting means (6) for trimming the logs retained within the housings (30) of the revolving unit (3), that is, for removing portions thereof of reduced extension in correspondence of their ends;

a chute (7) downstream of the revolving unit (3), for unloading the trimmed logs (2').

By way of example, and with reference to the drawings, the means (5) intended for loading the revolving unit (3), that is, for transferring the logs (2) from the plane (1) to the housings (30) of the revolving unit (3), comprise a body (52) which has square cross-section, developed in a direction parallel to that of incoming logs (2), is provided with peripheral seats (50) with L-shape profile (in the example, the seats 50 are in number of four and orthogonal to each other) and is mounted on a central shaft (51) associated with a corresponding driving motor (not shown in the drawings) to allow the rotation thereof about the respective longitudinal axis. The body (52) is positioned on the respective shaft (51) in such a way that, while a wing (501) of a seat (50) is in line with the entry plane (1) of logs (20), a wing (502) of another seat (50) is in line with one of the housings (30) presented by the revolving unit (3).

Again with reference to the accompanying drawings, the means (4) for retaining the logs (2) within the housings (30) of the revolving unit (3) are gripper means. More in particular, the means comprise a gripper for each housing (30), each gripper comprising two arcuate jaws (40) associated with an actuator (41) via a connecting linkage (42). The grippers are intended to retain the logs (2) by clamping them in proximity of their ends bases which project slightly from the housings provided by the revolving unit (3). For this purpose, the grippers can be mounted on the bases (31) of the revolving unit (3).

As far as the cutting means (6) are concerned, they comprise, as shown in the drawings, two circular blades (60) located at a preset distance one from the other and acting on corresponding planes orthogonal to the longitudinal axis of each log (2) to be trimmed.

In the example, each blade (60) is associated with a relevant electric motor (61) via a drive belt (62). The motors (61) are disposed on supports (63) mounted on a horizontal guide (64) to allow at least one of them to be moved parallel to the logs (2) under treatment, and thus adjusting the position thereof, in relation to the length of the same logs (as indicated by the dual arrow "G"), by means of a corresponding adjustment handwheel (65). The blades (60) are mounted at the end of corresponding arms (66) which are cantilever-mounted with respect to the supports (63) of motors (61) and are able to pivot on hinges (660) parallel to the axes of the logs, that is, parallel to the guide (64), to allow the adjustment of the position of the blades (60) in the respective operating planes, as the same blades gradually wear out (with reduction of their diameter), by means of corresponding adjustment handwheels (67).

Also represented in the drawings are sharpening means with grinding wheels (68) in correspondence of blades (60) for the continuous sharpening of the latter during their rotation.

The cutting tool for operating the trimming of the logs (2) can be of any type.

Figure 7:
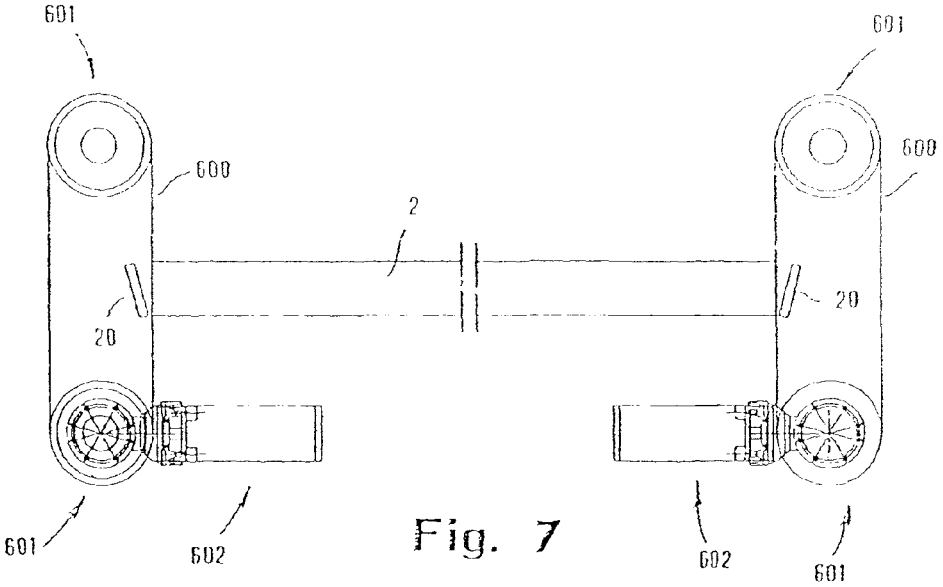
FIG. 7 is a view similar to that of FIG. 6, relating to an alternative embodiment of the invention.
Figure 8:
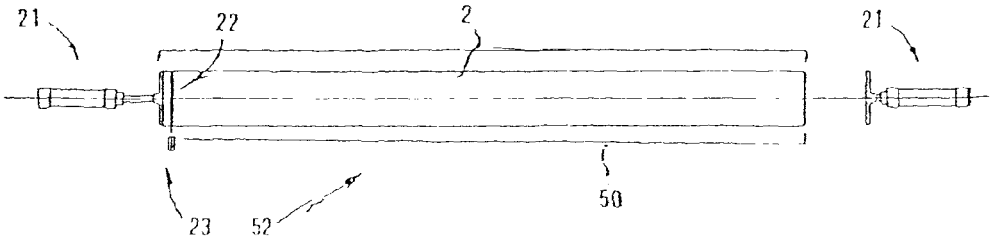
FIG. 8 is a schematic diagram relating to a step of longitudinal pre-positioning of a log.

For example, with reference to FIG. 7, in place of the circular blades (60), band blades (600) may be used which are loop-closed on corresponding driving-out pulleys (601) and associated with two electric motors (602) each of which drives a corresponding pulley (601) into rotation.

Figure 2:
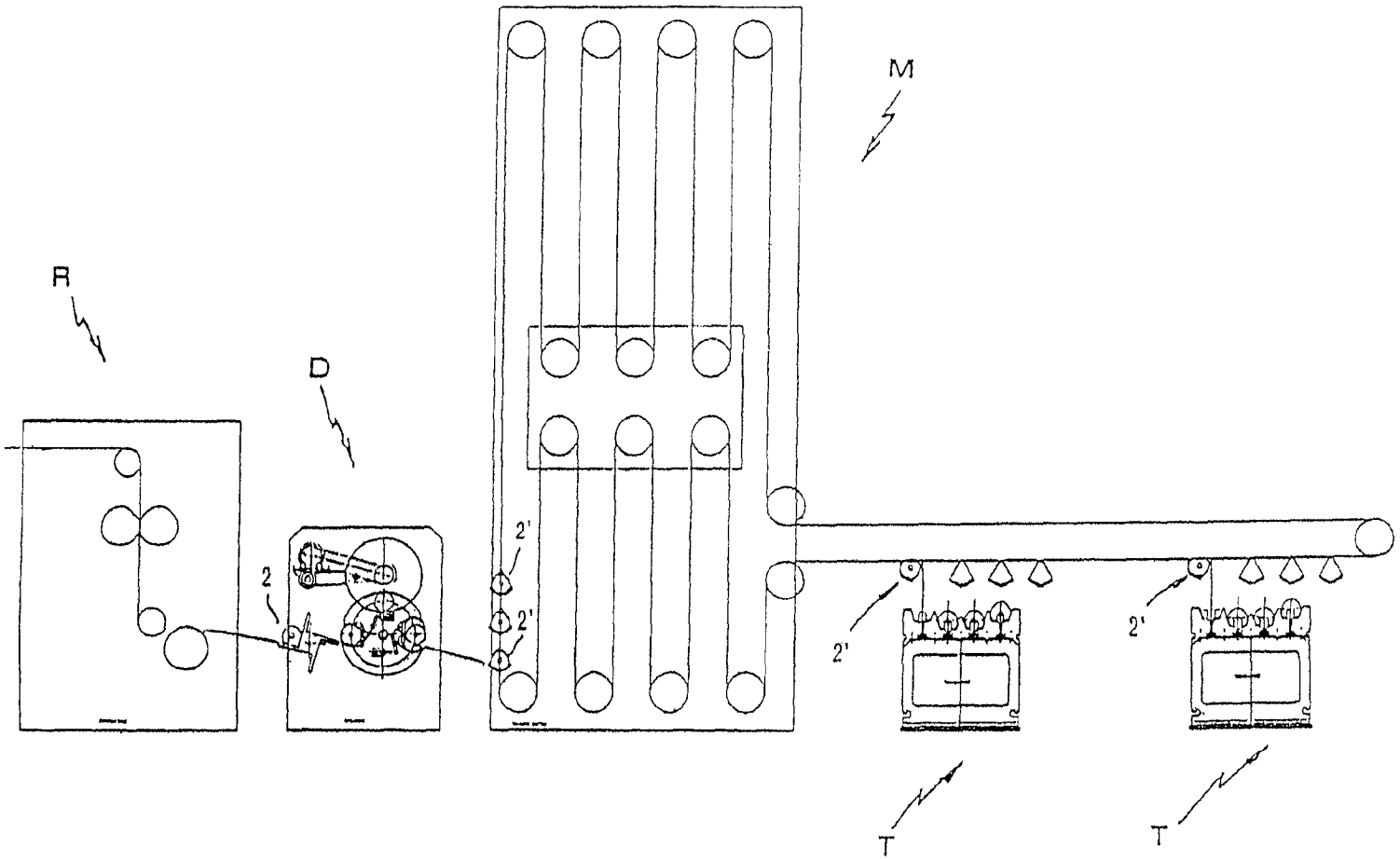
Figure 3:
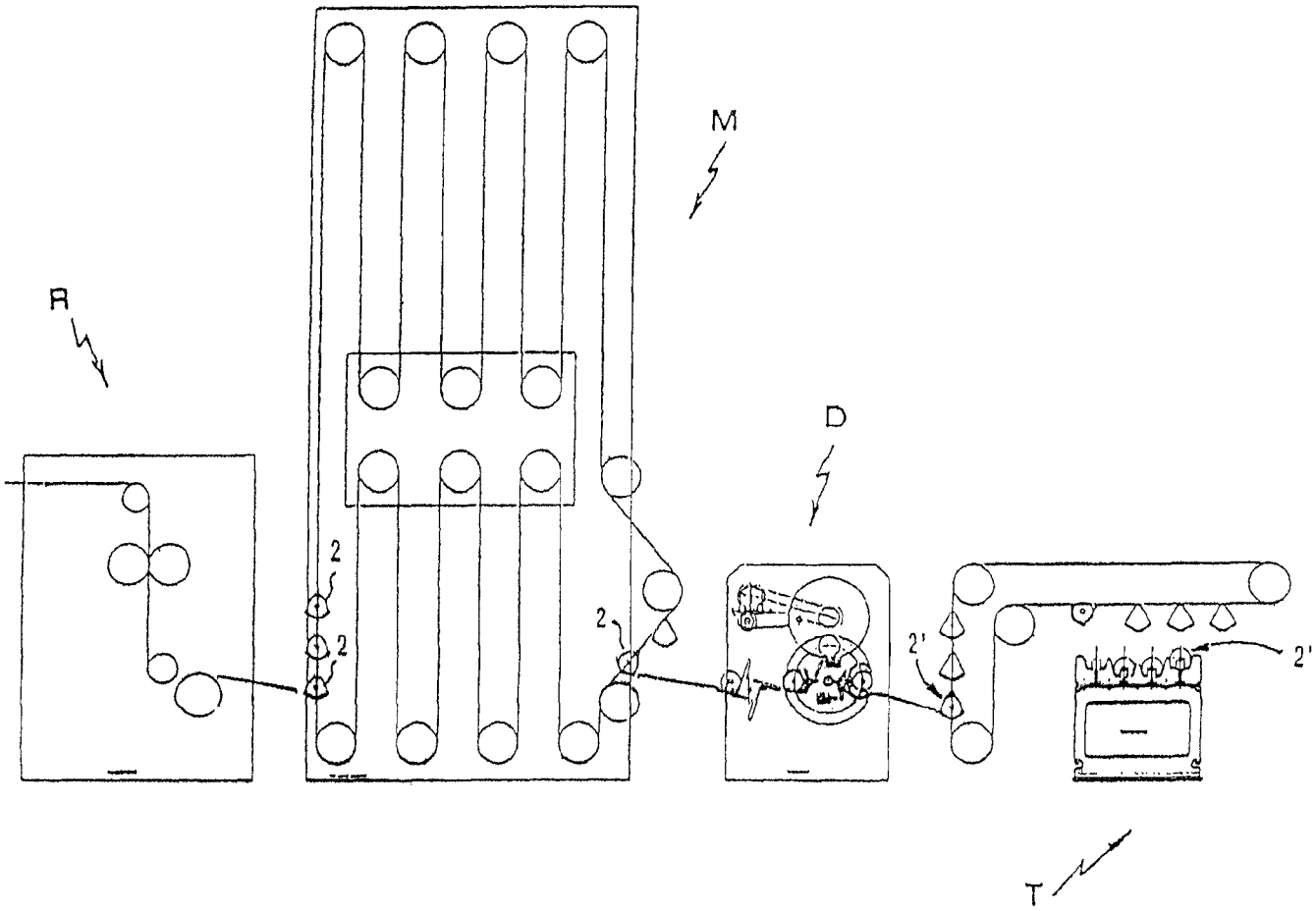
Figure 4:
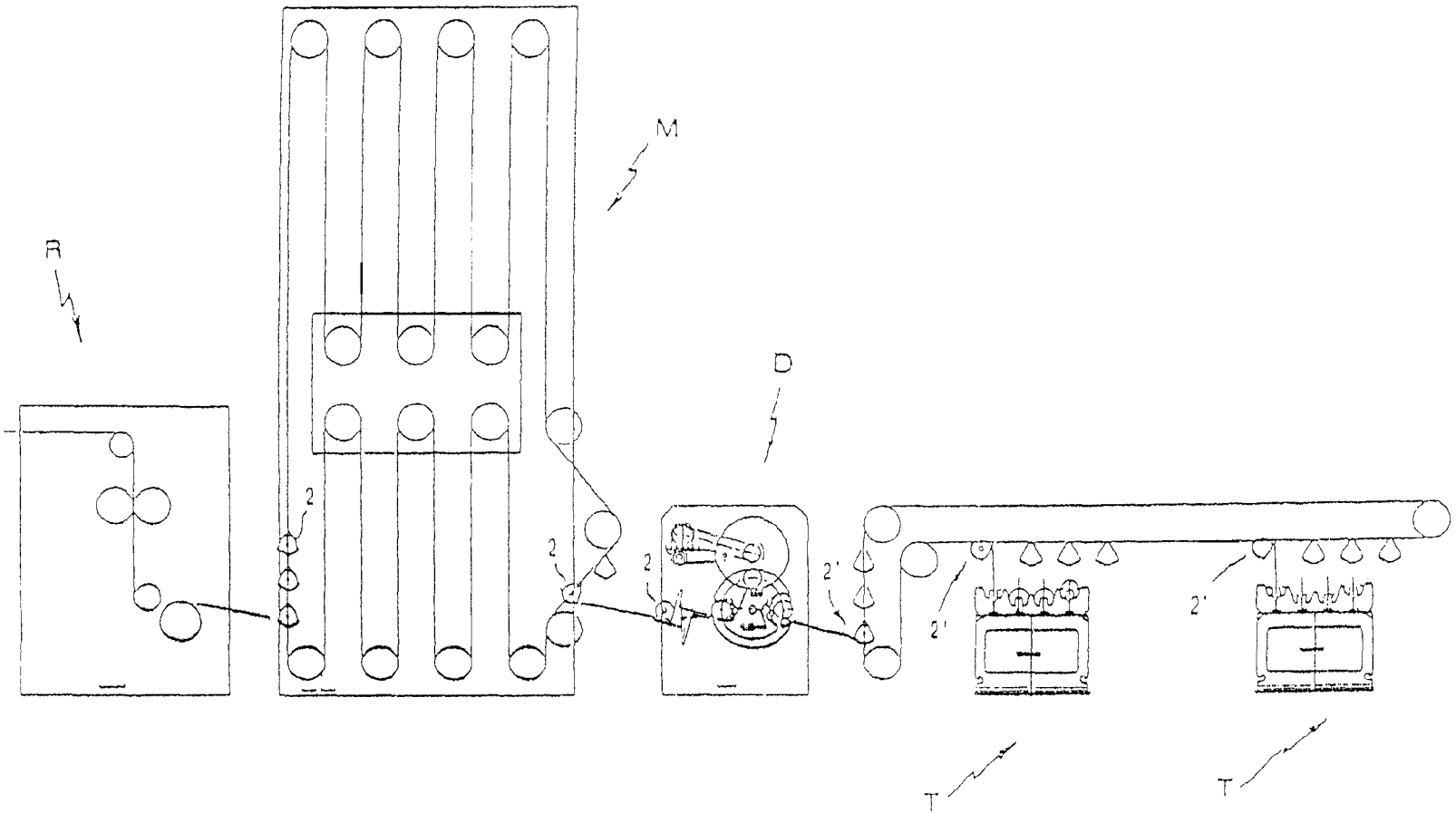

As illustrated in the schematic diagrams of FIGS. 1-4, an apparatus (D) according to the invention can be disposed both directly downstream of a rewinding machine (R) with associated means for closing the logs by glueing them—which machine is intended for the production of the logs (2)—as in FIGS. 1 and 2, and downstream of the a store (M) for the collection of logs, as in FIGS. 3 and 4.

In the first case, the trimmed logs (2') are fed into the store (M) which is located downstream of the apparatus (D) and, downstream of store (M) there are disposed one (FIG. 1) or two (FIG. 2) cutting-off machines (T) which receive from the store (M) the already trimmed logs (2') for dividing them into small rolls, that is, for dividing them into more elements of commercial size.

In the second case (FIGS. 3 and 4), the apparatus is disposed downstream of the store (M) and supplies one (FIG. 3) or two (FIG. 4) cutting-off machines (T).

In any case, the apparatus (D) is located upstream of one or more cutting-off machines (T) to which, therefore, come the already trimmed logs (2').

The structure and operation of the rewinding machines, of the stores and the cutting-off machines for the logs, are known to those skilled in the art and, therefore, a more detailed description thereof is omitted.

Figure 5A:
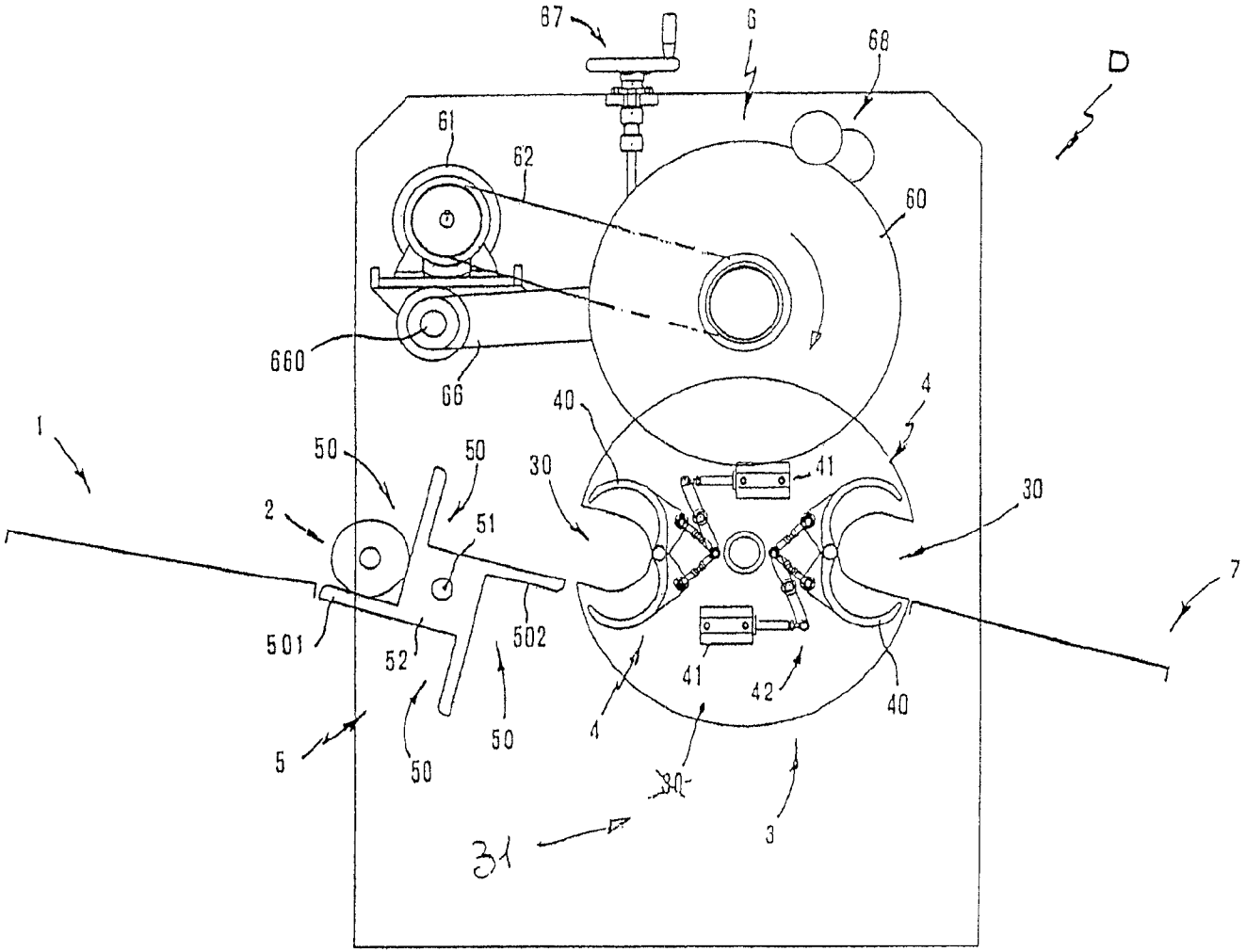
FIGS. 5A-5F are schematic side views in phantom of an apparatus according to the invention in a plurality of corresponding operating states.
Figure 5B:
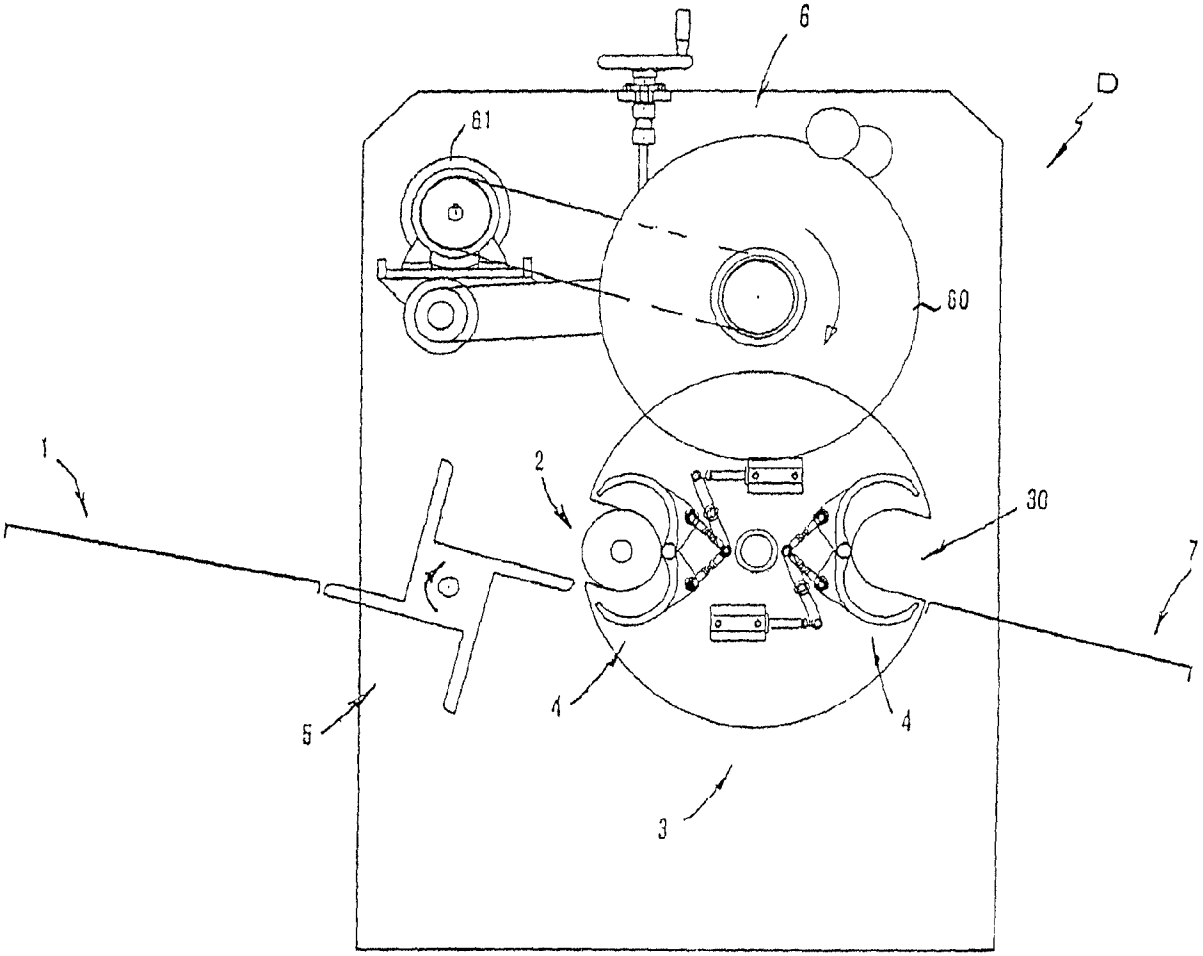
Figure 5C:
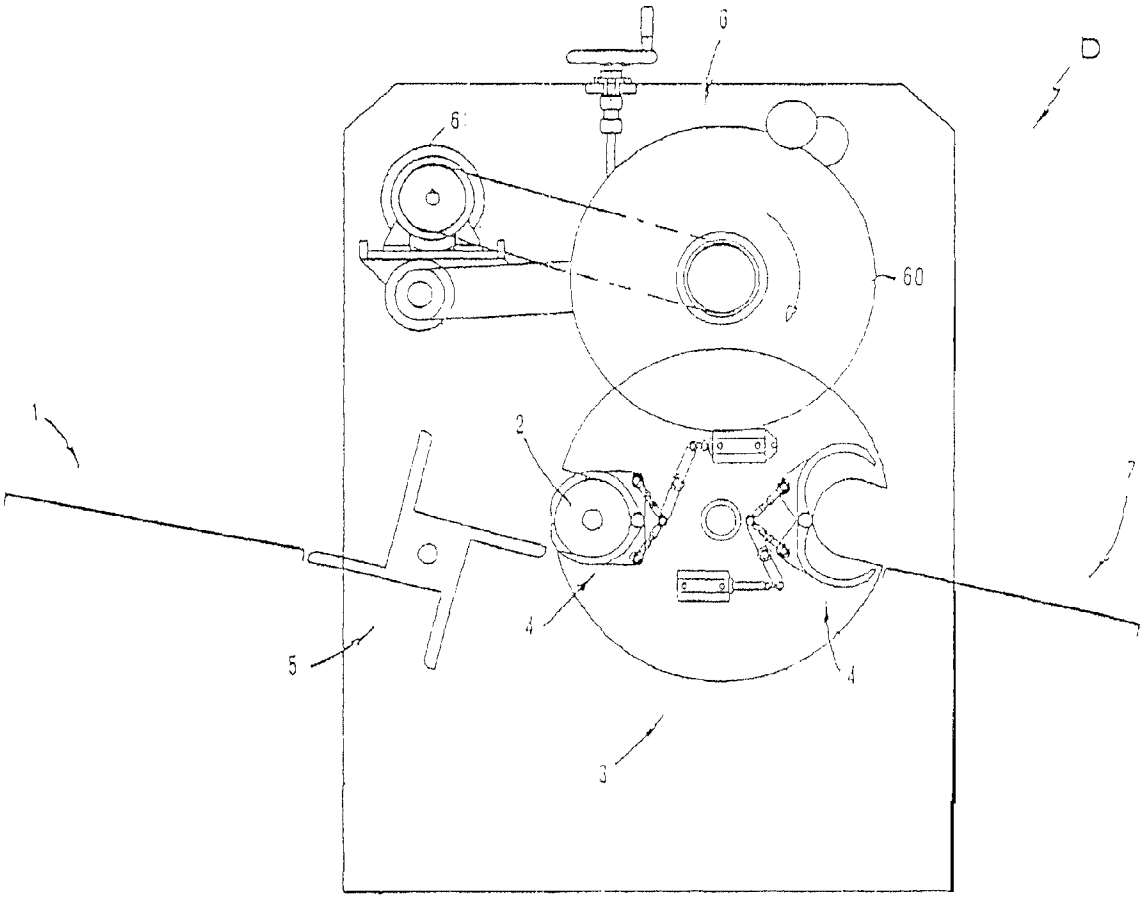
Figure 5D:
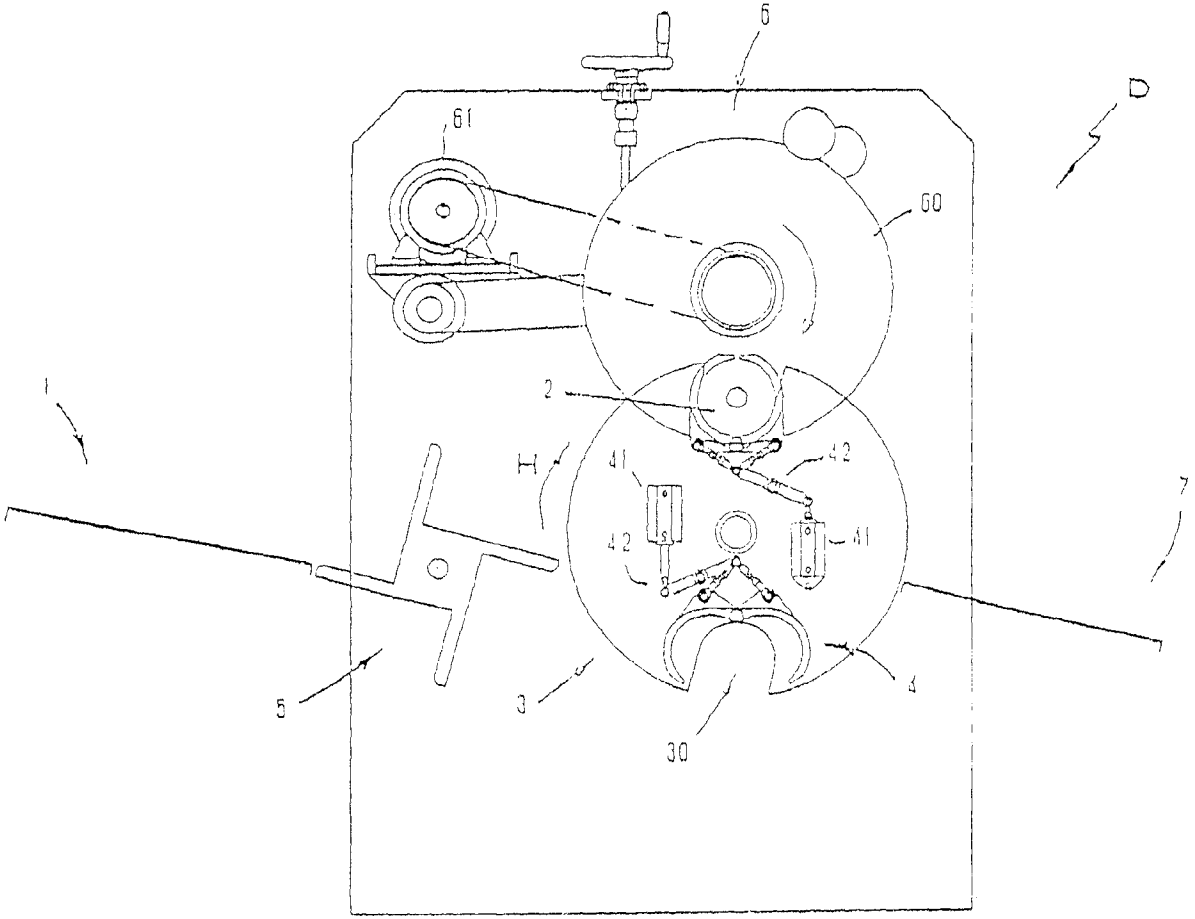
Figure 5E:
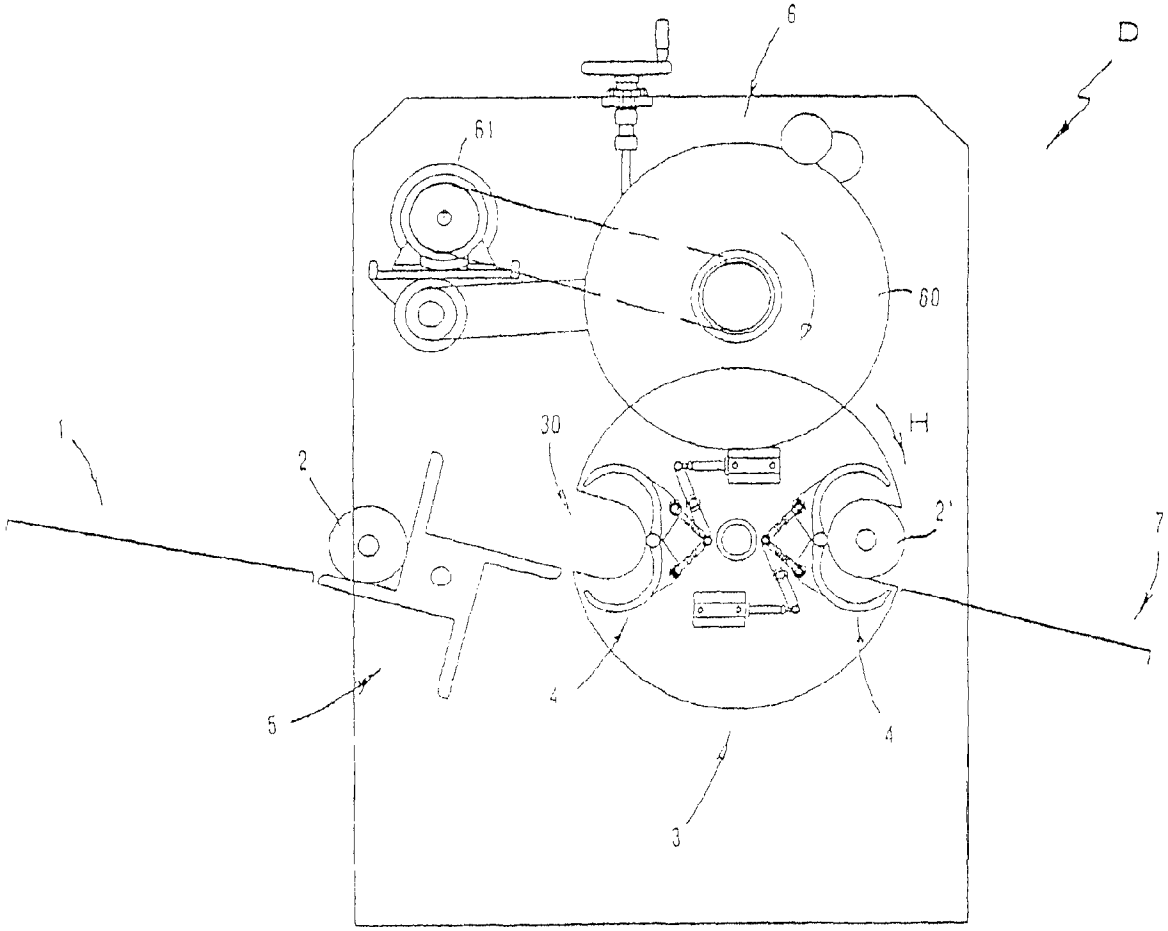
Figure 5F:
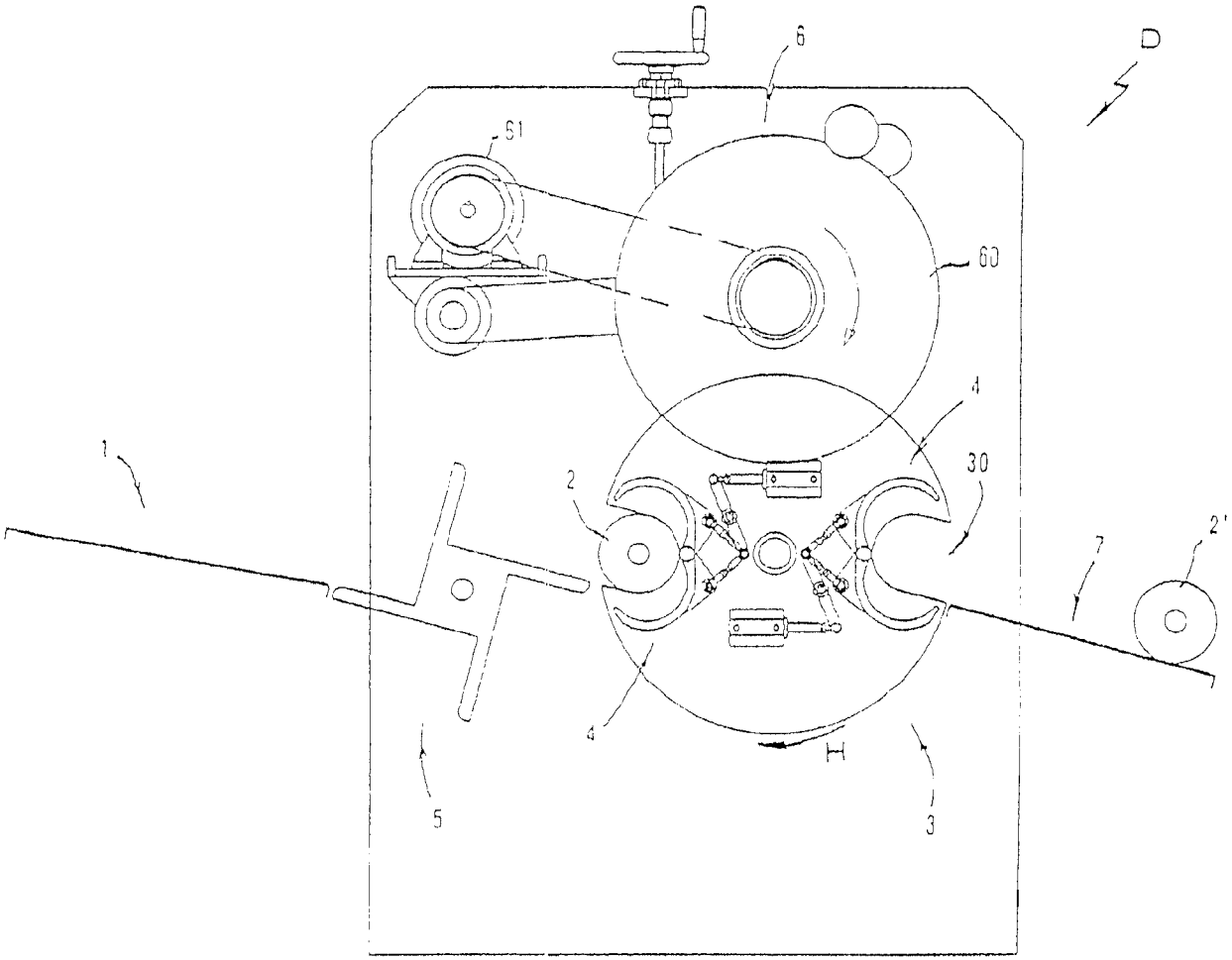
Figure 6:
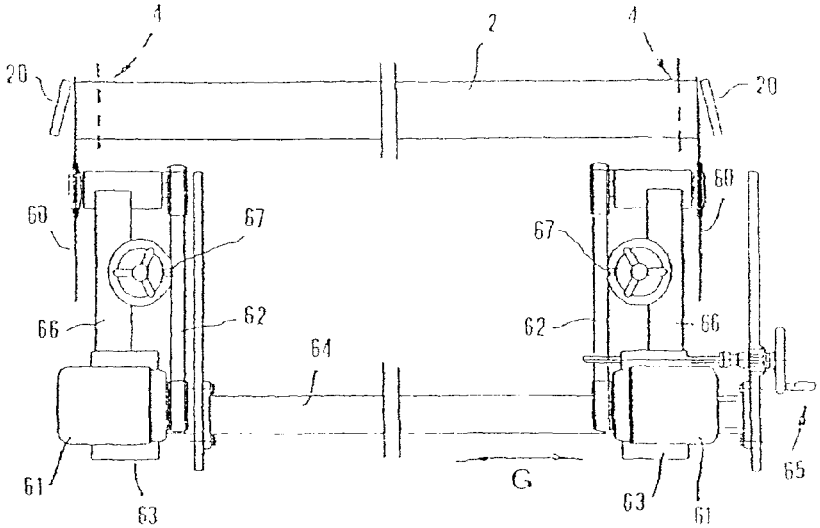
FIG. 6 is a schematic plan view of an apparatus according to the invention.

The normal operating condition of the apparatus (D), reference being made to the drawings of FIGS. 5A-6, is as follows.

A log (2) to be trimmed runs along the plane (1) by rolling over it until it results disposed within a seat (50) of the body (52) in a stand-by condition (FIG. 5A). In this location a step of longitudinal positioning the log (2) takes place by means of pneumatic pushers (21) disposed in line with the log (2) and acting on the bases thereof, so that a reference of the same log (for example, a colored line 22 or a figure printed on the paper of the logs) will result aligned with a fixed reference (e.g. one or more photo-transducers 23 located at a fixed position with respect to the body 52). At this point, the body (52) is rotated through 90°, so that the seat (50) of body (52) which houses the log will result in front of a housing (30) of the standing-by revolving unit (3) and, because of the inclination of the wing (502) of seat (52), the log (2) rolls towards and up to the housing (30) (FIG. 5B). Thereafter (FIG. 5C), the jaws (40) of the gripper associated with the housing (30) which now receives the log (2) clamp the latter (FIG. 5C) and the revolving unit revolves (arrow "H") in order to dispose the log in the cutting position under the blades (60) (FIG. 5D). During the revolving of the unit (3) the trimming of the logs takes place with the removal of a reduced portion thereof in correspondence of both their ends, as schematically represented also in FIG. 6. By a further revolution of the unit (3), as indicated in FIG. 5E, the log (2') thus trimmed is moved on in correspondence of the unloading chute (7), while the other housing (30) of the revolving unit (3) results in front of the body (52) which, in the meantime, has received another log (2) to be trimmed. At this point, the jaws of the gripper which retains the trimmed log (2') open up, thereby releasing the log (2')

which can roll along the discharge plane (7) (FIG. 5F). The cycle is then repeated identically.

The trimming step can be performed over a time longer than that spent for the same operation made by the common cutting-off machines. Besides, since the blades (60) are specifically intended for trimming the logs and not also for their cutting-off, the shape of the relevant chamfers can be chosen among those most suited for this specific work.

A process according to the invention provides in practice for supplying one or more cutting-off machines (T) with logs (2') already trimmed, which can be made by having a log-trimming apparatus located upstream of the same cutting-off machines (T).

In this way, the small rolls produced by the cutting-off machines result with no trim to be separated and, since the logs (2') fed to the machines are already trimmed, they have the desired constant dimensional and consistence characteristics in correspondence of their bases. In addition to this, the production of the trims (20) and, consequently, the collection thereof, takes place only in correspondence of the apparatus (D) and not also in correspondence of the cutting-off machines (T), thereby improving the trims-recover and disposal operations. Moreover, as it is possible to use cutting-off machines with no trimming and trim-removal means, the manufacturing of such machines is simpler and more economical.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

While specific embodiments of the invention have been shown and described in detail to illustrate the application of the principles of the invention, it will be understood that the invention may be embodied otherwise without departing from such principles.

What is claimed is:

1. An apparatus for producing small paper rolls, the apparatus comprising:

a rewinding machine, said rewinding machine producing elongated uncut paper rolls;

a paper rolls store element, said paper rolls store element receiving said rolls from said rewinding machine to store said uncut paper rolls;

a trimming device receiving the uncut paper rolls from said paper rolls store element, said trimming device trimming at least one end of each roll produced by said rewinding machine to form trimmed rolls, said trimming device comprising a revolving unit, said revolving unit comprising a first gripper and a second gripper, said first gripper being actuatable independent of said second gripper; and a cutting-off machine, said trimming device supplying said trimmed rolls to said cutting-off machine, said cutting-off machine subdividing the trimmed rolls into a plurality of small rolls, said cutting-off machine being separate from said trimming device.

2. An apparatus according to claim 1, wherein said trimming device includes:

a receiving portion for receiving said uncut paper rolls;

a releasing portion for releasing said cut paper rolls;

a cutting portion with cutting means for cutting said uncut paper rolls, said revolving unit being located between said receiving portion and said releasing portion, said revolving unit transferring said paper rolls from said receiving portion, said cutting portion and said releasing portion, said revolving unit being rotatable about a revolving unit axis, wherein said at least one end of at least one of the uncut paper rolls is cut as said revolving unit transfers the at least one of the uncut paper rolls from said receiving portion to said releasing portion, wherein the at least one of the uncut paper rolls is cut as said revolving unit rotates about said revolving unit axis.

3. An apparatus according to claim 2, wherein said trimming device includes a rotating roll delivery means for transferring the rolls from said entry portion to said revolving unit, said rotating roll delivery means being disposed between said receiving portion and said revolving unit, said rotating log delivery means comprising a body, said body being mounted on a shaft parallel to the logs which enter said receiving portion, said body having a plurality of projections, said projections extending in an outward direction from said body, said projections defining a plurality of seats, wherein each of said projections is perpendicular to another one of said projections, each seat being perpendicular to another seat.

4. An apparatus according to claim 2, wherein said trimming device is located downstream of said paper rolls store element, said cutting-off machine being located downstream of said paper rolls store element, said trimming device being located downstream of said rewinding machine.

5. An apparatus according to claim 4, wherein said rewinding machine, said paper rolls store element and a portion of said trimming device define an uncut paper roll path, said uncut paper rolls moving from said rewinding machine to said paper rolls store element and said uncut paper rolls moving from said paper rolls store element along said uncut paper roll path, said cutting-off machine and another portion of said trimming device defining a trimmed paper roll path, said trimmed paper rolls being moved along said trimmed paper roll path from said trimming device to said cutting-off machine.

6. An apparatus according to claim 1, wherein said uncut paper rolls are moved from said rewinding machine to said paper rolls store element and said uncut paper rolls are moved from said paper rolls store element to said trimming device to define an uncut paper roll path, said trimmed paper rolls being moved from said trimming device to said cutting-off machine to define a trimmed paper roll path.

7. An apparatus for producing small paper logs, the apparatus comprising:

a rewinding machine, said rewinding machine producing elongated uncut paper logs;

an uncut paper log storing unit having a moving means for moving said uncut paper logs, said uncut paper log storing unit receiving said uncut paper logs from said rewinding machine, said uncut paper log storing unit storing said uncut paper logs;

a first paper log cutting device comprising a rotatable unit, said rotatable unit comprising a rotatable unit axis, said rotatable unit comprising a first gripper device and a second gripper device, said first gripper device being movable independent of movement of said second gripper device, said first paper log cutting device receiving said uncut paper logs from said uncut paper log storing unit via said moving means, said first paper log cutting device cutting each end of each uncut paper log received from said uncut paper log storing unit as said rotatable unit is rotated about said rotatable unit axis to form trimmed paper logs; and a second paper log cutting device, said second paper log cutting device being separate from said first paper log cutting device and said second paper log cutting device being operated independent of said first log cutting device, said second paper log cutting device receiving said trimmed paper logs from said first paper log cutting device, said second paper log cutting device cutting each trimmed log into a plurality of rolls, each roll having a length that is less than a length of one of said trimmed paper logs.

8. An apparatus according to claim 7, wherein said first paper log cutting device includes:

a receiving portion for receiving said paper logs;

a releasing portion for releasing said cut paper logs;

a cutting portion with cutting means for cutting said paper logs, said rotatable unit transferring said paper logs from said receiving portion, said cutting portion and said releasing portion.

9. An apparatus according to claim 8, wherein said first paper log cutting device includes a rotating log delivery means for transferring the logs from said entry portion to said rotatable unit, said rotating log delivery means being disposed between said receiving portion and said rotatable unit, said rotating log delivery means comprising a body, said body being mounted on a shaft parallel to the logs which enter said receiving portion, said body having a plurality of wings, said wings defining a plurality of seats, each seat being perpendicular to another seat, wherein each of said wings is perpendicular to another one of said wings.

10. An apparatus according to claim 7, wherein said second cutting device is located downstream of said first cutting device, said second cutting device being located downstream of said trimmed paper log storing unit.

11. An apparatus according to claim 10, wherein said rewinding machine, said uncut paper log storing unit and a portion of said first paper log cutting device define an uncut paper roll path, said uncut paper rolls moving from said rewinding machine to said uncut paper log storing unit and said uncut paper rolls moving from said uncut paper log storing unit along said uncut paper roll path, said second paper log cutting device and another portion of said first paper log cutting device defining a trimmed paper roll path, said trimmed paper rolls moving along said trimmed paper roll path from said first paper log cutting device to said second paper log cutting device.

12. An apparatus according to claim 7, wherein said uncut paper logs move from said rewinding machine to said uncut paper log storing unit and said uncut paper rolls move from said uncut paper log storing unit to said first cutting device to define an uncut paper roll path, said trimmed paper rolls moving from said first cutting device to said second cutting device to define a trimmed paper roll path.

13. An apparatus for producing small paper rolls, the apparatus comprising:

a first cutting device comprising a rotatable unit, said rotatable unit comprising a plurality of grippers and a rotatable unit axis, each of said grippers being movable relative to said rotatable unit, said rotatable unit receiving uncut paper rolls, said first cutting device cutting at least one end of each of said uncut paper rolls as said rotatable unit is rotated about said rotatable unit axis to form a plurality of trimmed rolls; and a second cutting device located downstream of said first cutting device, said second cutting device receiving said trimmed rolls from said first cutting device, said second cutting device cutting each of said trimmed rolls to form a plurality of subdivided rolls, each of said subdivided rolls having a length that is less than a length of each of said trimmed rolls, said first cutting device being detached from said second cutting device, wherein said second cutting device is actuated independent of said first cutting device.

14. An apparatus according to claim 13, further comprising:

a rewinding machine, said rewinding machine producing said uncut paper rolls; and a paper rolls store element, said paper rolls store element receiving said uncut paper rolls from said rewinding machine to store said uncut paper rolls, said first cutting device receiving said uncut paper rolls from said paper rolls store element.

15. An apparatus according to claim 14, wherein said first cutting device comprises:

a receiving portion for receiving said uncut paper rolls;

a releasing portion for releasing said trimmed rolls;

a cutting portion with cutting means for cutting said uncut paper rolls, said rotatable unit being arranged between said receiving portion and said releasing portion, said rotatable unit transferring said paper rolls from said receiving portion, said cutting portion and said releasing portion.

16. An apparatus according to claim 15, wherein said first cutting device includes a rotating roll delivery means for transferring the rolls from said entry portion to said rotatable unit, said rotating roll delivery means being disposed between said receiving portion and said rotatable unit, said rotating log delivery means comprising a body, said body being mounted on a shaft parallel to the logs which enter said receiving portion, said body having a plurality of projections, said plurality of projections extending from said body, said projections defining a plurality of seats, each seat being perpendicular to another seat, wherein each of said projections is perpendicular to another one of said projections.

17. An apparatus according to claim 16, wherein said first cutting device is located downstream of said paper rolls store element, said second cutting device being located downstream of said paper rolls store element, said first cutting device being located downstream of said rewinding machine.

* * * * *